United States Patent [19]

Goffe, deceased et al.

[11] 4,075,017

[45] Feb. 21, 1978

[54] PHOTOTHERMOGRAPHIC MATERIAL CONTAINING A COMBINATION OF ENERGY-SENSITIVE ORGANIC DYES AND PROCESS OF FORMING A POSITIVE OR NEGATIVE IMAGE WITH THE MATERIAL

[75] Inventors: Charles A. Goffe, deceased, late of Brockport, N.Y., by Patricia Anne Goffe, executrix; Donald W. Heseltine, Rochester, N.Y.

[73] Assignee: Eastman Kodak Company, Rochester, N.Y.

[21] Appl. No.: 689,325

[22] Filed: May 24, 1976

[51] Int. Cl.[2] ..... G03C 5/24; G03C 3/26

[52] U.S. Cl. ..... 96/48 HD; 427/56

[58] Field of Search ..... 96/114.1, 48 HD; 427/56

[56] References Cited

U.S. PATENT DOCUMENTS

| | | | |
|---|---|---|---|
| 3,152,903 | 10/1964 | Shepard et al. | 96/114.1 |
| 3,409,438 | 11/1968 | Lokken | 96/114.1 |
| 3,649,275 | 3/1972 | McNally, Jr. et al. | 96/48 |
| 3,672,904 | 6/1972 | de Mauriac | 96/114.1 |

FOREIGN PATENT DOCUMENTS

| | | |
|---|---|---|
| 788,279 | 6/1972 | Belgium. |
| 2,402,536 | 8/1974 | Germany. |
| 1,399,751 | 7/1975 | United Kingdom. |

OTHER PUBLICATIONS

Research Disclosure, Oct. 1974, Item #12617.

*Primary Examiner*—David Klein
*Assistant Examiner*—Louis Falasco
*Attorney, Agent, or Firm*—Richard E. Knapp

[57] ABSTRACT

A photothermographic element comprises a combination of certain energy sensitive organic dyes capable of forming or destroying an active spcies upon selective exposure to actinic radiation to give a positive or negative image after heat development of the element. The element also comprises an oxidation-reduction image-forming composition comprising a silver salt oxidizing agent and a non-radiation sensitive organic reducing agent.

45 Claims, No Drawings

PHOTOTHERMOGRAPHIC MATERIAL CONTAINING A COMBINATION OF ENERGY-SENSITIVE ORGANIC DYES AND PROCESS OF FORMING A POSITIVE OR NEGATIVE IMAGE WITH THE MATERIAL

BACKGROUND OF THE INVENTION

1. Field of the Invention

This invention relates to the combination of certain energy sensitive organic dyes in photothermographic elements, compositions and processes which do not require the presence of a silver halide to provide a developed image using a reasonably short exposure time. By a selective exposure technique either a negative or a positive image can be obtained. In one of its aspects, this invention relates to photothermographic elements containing said combination of dyes. In another of its aspects it relates to a photothermographic composition containing the described combination of dyes. A further aspect relates to a method of developing a latent image in the described photothermographic elements to a negative image by overall heating or to a positive image by imagewise exposure to ultraviolet light and subsequent exposure to a tungsten lamp followed by overall heating.

2. Description of the State of the Art

It is known in the art to provide photothermographic materials containing silver halide which can be imagewise exposed and heat developed to form negative photographic images. Such photothermographic materials after exposure are heated overall to provide a developed negative image in the absence of separate processing solutions. Reducing agents which have been employed with silver halide in photothermographic materials are described, for example, in Belgian Pat. No. 765,452, issued May 28, 1971; Belgian Pat. No. 765,602, issued May 28, 1971; Belgian Pat. No. 765,601, issued May 28, 1971; Belgian Pat. No. 766,590, issued June 15, 1971; Belgian Pat. No. 766,589, issued June 15, 1971; Belgian Pat. No. 772,371, issued Oct. 15, 1971; U.S. Pat. No. 3,152,904 of Sorenson et al., issued Oct. 13, 1964; U.S. Pat. No. 3,152,903 of Sorenson et al., issued Oct. 13, 1964; U.S. Pat. No. 3,457,075 of Morgan et al., issued July 22, 1969; U.S. Pat. No. 3,392,020 of Yutzy et al., issued July 9, 1968 and British Specification No. 1,161,777, published Aug. 20, 1969. The use of photographic silver halides, however, to get high contrast film in the prior art is undesirable. The high expense and shortage of silver has resulted in a continuing search for substitutes. However, at this time, no material has been found to provide high contrast at reasonable exposure times.

One method of developing photothermographic materials without a silver halide component is described in Lokken U.S. Pat. No. 3,409,438. This method entails the use of certain compounds with reducing agents to form a negative image after heat development. These photothermographic elements are not capable of forming high contrast images after being exposed for short periods of time or of producing either negative or positive images depending upon the exposure technique used.

The use of certain nitrobenzylidene dyes as impregnants for support materials for photographic elements containing silver halide is described in Belgian Pat. No. 788,279.

The use of dyes containing a heterocyclic nitrogen atom which is substituted by a member selected from the group consisting of an alkoxy group and an acyloxy group as precursors for physcial development is described in U.S. Pat. No. 3,649,275, issued Mar. 14, 1972 to McNally et al.

A non-silver-halide containing photothermographic element has not been found that is capable of being exposed for a short time and subsequently heat developed to a high contrast negative or positive image.

Accordingly, there has been a continuing need to provide improved photothermographic elements, compositions and processes that do not contain silver halide and which provide the high contrast between Dmax and Dmin images with a minimum of exposure time and an option of producing negative or positive images.

SUMMARY OF THE INVENTION

It has been found, according to the invention, that a high contrast negative or positive image can be obtained using a relatively short exposure time in a non-silver halide photothermographic element and composition comprising a combination of certain energy-sensitive organic dyes. The combination of energy-sensitive organic dyes can be employed in a photothermographic material comprising an oxidation-reduction combination comprising a silver salt oxidizing agent and a non-light sensitive reducing agent and a binder. The combination of energy-sensitive organic dyes enables not only the omission of silver halide from the described photothermographic material but also provides the alternative of preparing a negative or a positive image from the same element.

DETAILED DESCRIPTION OF THE INVENTION

The non-silver halide photothermographic compositions of this invention comprise the combination of certain energy-sensitive dyes, a silver salt oxidizing agent, a reducing agent and a binder.

The combination of energy-sensitive dyes comprises a photosensitive, o-nitro-substituted arylidene reducing agent precursor and a photosensitive dye containing a heterocyclic nitrogen atom which is substituted by an alkoxy group or an acyloxy group.

The term "photosensitive reducing agent precursor" as employed herein is intended to mean a dye capable of forming a reducing agent (photoreductant) upon irradiation with light. The exposing source should encompass that region of the spectrum absorbed by the reducing agent precursor.

As employed herein the term "arylidene" refers to the group formed by an aryl group and a methine linkage, e.g., benzylidene, cinnamylidene, etc. The arylidene dyes, according to this invention, contain an o-nitro-substituted aryl group joined through a methine chain linkage to a basic heterocyclic nucleus containing en electron-donating atom, typically a nitrogen, oxygen or sulfur electron-donating atom. The number of atoms joining the electron-donating atom and the aryl group is typically an even number. In a preferred form the o-nitro-substituted aryl group is joined through an acyclic methine chain containing an odd number of methine groups to a 5- or 6-membered basic, cyanine dye type heterocyclic nucleus. The heterocyclic nucleus can have additional carbocyclic and heterocyclic rings fused thereto. The o-nitro-substituted aryl group can contain a phenyl nucleus or can contain a nucleus formed by fused aromatic rings, such as naphthyl, etc.

In a specific preferred embodiment of this invention, the photosensitive o-nitro-substituted dyes which function as reducing agent precursors have the formula:

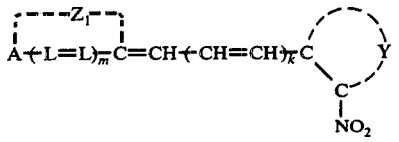

I.

wherein:

(a) $k$ represents 0 or 1;

(b) $m$ represents 0 or 1;

(c) each L represents a methine group, including substituted methine groups, (e.g., —CH=, —C(CH$_3$)=, etc.);

(d) A represents an electron donating moiety, such as oxygen (—O—), sulfur (—S—), or (e) $R_1$ represents (1) an alkyl group having from 1 to 18 carbon atoms and preferably a lower alkyl group having from 1 to 4 carbon atoms (e.g., methyl, ethyl, propyl, isopropyl, butyl, secondary-butyl, isobutyl, tert-butyl, pentyl, hexyl, octyl, decyl, dodecyl, octadecyl); a sulfoalkyl group, preferably sulfo lower alkyl containing from 1 to 4 carbon atoms in the alkyl moiety (e.g., β-sulfoethyl, γ-sulfopropyl, γ-sulfobutyl, δ-sulfobutyl, etc.); a carboxyalkyl group, preferably a carboxy lower alkyl containing from 1 to 4 carbon atoms in the alkyl moiety (e.g., β-carboxyethyl, γ-carboxypropyl δ-carboxybutyl, etc.), a sulfatoalkyl group, preferably a sulfato lower alkyl containing from 1 to 4 carbon atoms in the alkyl moiety (e.g., β-sulfatoethyl, γ-sulfatopropyl, δ-sulfatobutyl, etc.); an alkoxyalkyl group, preferably a lower alkoxy lower alkyl containing from 1 to 4 carbon atoms in both the alkoxy and alkyl moieties (e.g., β-methoxyethyl, γ-methoxypropyl, δ-propoxybutyl, etc.); an acyloxyalkyl group, preferably an acyloxy lower alkyl containing from 1 to 4 carbon atoms in the alkyl moiety (e.g., acetyloxyethyl, propanoyloxyethyl, butanoyloxybutyl, benzoyloxyethyl, toloyloxypropyl, etc.); an alkoxycarbonylalkyl group, preferably a lower alkoxy carbonyl lower alkyl containing 1 to 4 carbon atoms in both the alkoxy and alkyl moieties (e.g., β-methoxycarbonylethyl, δ-ethoxycarbonylbutyl, β-butoxycarbonylethyl, etc.); a dialkylaminoalkylene group, preferably a di-lower alkylamino lower alkylene containing 1 to 4 carbon atoms in the alkylene and alkyl moieties (e.g., dimethylaminoethylene, diethylaminopropylene, diethylaminobutylene, etc.); a cycloaminoalkylene group, preferably cycloamino lower alkyl containing 4 to 6 atoms in the cyclamino moiety and 1 to 4 atoms in the alkyl moiety (e.g., pyrrolidinylethylene, morpholinopropylene, piperidinobutylene, pyrrolinylmethylene, etc.); (2) an alkenyl group (including a substituted alkenyl group), preferably a lower alkenyl containing 2 to 4 carbon atoms (e.g., ethenyl, allyl, 1-propenyl, 1-butenyl, 2-butenyl, etc.), or (3) an aryl group (including a substituted aryl)--e.g., phenyl, naphthyl, tolyl, xylyl, halopehnyl such as p-chlorophenyl, p-bromophenyl, etc., alkoxyphenyl such as methoxyphenyl, 2,4-dichlorophenyl, etc. and an aralkyl group, preferably an aryl lower alkyl containing from 1 to 4 carbon atoms in the alkyl moiety (e.g., benzyl, β-phenethyl, ω-phenbutyl, etc.)

(f) Y represents the atoms necessary to complete an aryl (preferably phenyl or naphthyl) ring which is ortho-nitro-substituted and preferably is also para-substituted with a nitro or other electron-withdrawing group such as

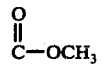

and which can have other substituents attached to it and other carbocyclic rings fused to it (e.g., 2-nitrophenyl, 2,4-dinitrophenyl, 2,6-dinitrophenyl, 2,4,6-trinitrophenyl, 2-nitronaphthyl, 2,4-dinitronaphthyl, 2-nitro-4-cyanophenyl, 2-nitro-4-ethoxycarbonylphenyl, 2-nitro-4-trifluoro-methylphenyl, and the like); and (g) $Z_1$ represents the nonmetallic atoms necessary to complete a heterocyclic nucleus of the type used in cyanine dyes containing 5 or 6 atoms in the heterocyclic ring containing the electron-donating atom of the formula which ring can contain a second hetero atom such as oxygen, nitrogen, selenium or sulfur. The heterocyclic nucleus preferably is selected from the group consisting of a thiazole nucleus including substituted and unsubstitued benzothiazole and naphthothiazole nuclei and like, (e.g., thiazole, 4-methylthiazole, 4-phenylthiazole, 4,5-diphenylthiazole, 4-(2-thienyl)thiazole, benzothiazole, 4-chlorobenzothiazole, 4-methylbenzothiazole, 4-methoxybenzothiazole, 4-ethoxybenzothiazole, 4-phenylbenzothiazole, 5-chlorobenzothiazole, 5-bromobenzothiazole, 5-methylbenzothiazole, 5-methoxybenzothiazole, 5-ethoxybenzothiazole, 5-phenylbenzothiazole, 6-chlorobenzothiazole, 6-bromobenzothiazole, 6-methylbenzothiaZole, 6-methoxybenzothiazole, 6-ethoxybenzothiazole, 5-methoxynaphtha[2,3-d]thiazole, β-naphthothiazole, α-naphthothiazole, 5-nitrobenzothiazole, 6-nitrobenzothiazole, 5-chloro-6-nitrobenzothiazole, etc.); an oxazole nucleus including substituted and unsubstituted benzoxazole and naphthoxazole nuclei and the like, (e.g., oxazole, 4-phenyloxazole, benzoxazole, 5-chlorobenzoxazole, 5-methylbenzoxazole, 5-bromobenzoxazole, 5-methoxybenzoxazole, 5-ethoxybenzoxazole, 5-phenylbenzoxazole, 5-methoxynaphthoxazole, 5-nitrobenzoxazole, 6-nitrobenzoxazole, 5-chloro-6-nitrobenzoxazole, etc.); a selenazole nucleus including substituted and unsubstituted benzoselenazole and naphthoselenazole nuclei and the like, (e.g., selenazole, 4-methylselenazole, 4-4-nitroselenazole, 4-phenylselenazole, benzoselenazole, 5-chlorobenzoselenazole, 6-chlorobenzoselenazole, naphtho[2,1-d]-selenazole, 5-nitrobenzoselenazole, 6-nitrobenzoselenazole, 5-chloro-6-nitrobenzoselenazole, nitro group-substituted naphthoselenazoles, etc.); a thiazoline nucleus, (e.g., thiazoline, 4-methylthiazoline, 4-nitrothiazoline, etc.); a 2-pyridine nucleus, (e.g., 2-pyridine, 5-methyl2-pyridine, etc.); a 4-pyridine nucleus, (e.g., 4-pyridine, 3-methyl-4-pyridine, nitro group-substituted pyridines, etc.); a 3,3-dialkylindolenine nucleus (e.g., 3,3-dimethylindolenine, 3,3-diethyl-5 or 6-cyanoindolenine, 3,3-diethyl-5 or 6-nitroindolenine, 3,3-dimethyl-5 or 6-nitroindolenine, etc.); an imidazole nucleus, (e.g., imidazole, 1-alkylimidazole, benzimidazole, 1,3-dialkyl, 1,3-diaryl or 1-alkyl-3-arylimidazoles and benzimidazoles, such as 5-chloro-1,3-dialkylbenzimidazoles, 5-chloro-1,4-diarylbenzimidazoles, 5,6-dichloro-1,3-diarylbenzimidazoles, 5-methoxy-1,3-dialkylbenzimidazoles, 5-methoxy-1,3-diarylbenzimidazoles, 5-cyano-1,3-dialkylbenzimidazoles, 5-cyano-1,3-diarylbenzimidazoles, 1,3-dialkylnaphth[1,2-d]imidazole, 1,3-diarylnaphth[2,1-d]imidazole, etc.); a quinoline nucleus, (e.g., quinoline, 6-methylquinoline, 6-methoxyquinoline, 6-ethoxyquinoline, 6-chloroquinoline, 4-methoxyquinoline, 4-methylquinoline, 8-methoxyquinoline, β-methylquinoline, 4-chloroquinoline, 6-nitroquinoline, etc.); an imidazo[4,5-b]quinoxaline nucleus (as described in Brooker and Van Lare, U.S. Pat. No. 3,431,111), (e.g., imidazo[4,5-b]quinoxaline, 1,3-dialkylimidazo[4,5-b]quinoxaline such as 1,3-diethylimidazo[4,5-b]quinoxaline, 6-chloro-1,3-diethylimidazo[4,5-b]quinoxaline, etc., 1,3-dialkenylimidazo[4,5-b]quinoxaline such as 1,3-diallylimidazo[4,5-b]quinoxaline, 6-chloro-1,3-diallylimidazo[4,5-b]quinoxaline, etc., 1,3-diarylimidazo[4,5-b]quinoxaline such s 1,3-diphenylimidazo[4,5-b]quinoxaline, 6-chloro-1,3-diphenylimidazo[4,5-b]quinoxaline, etc.); a 3H-pyrrolo[2,3-b]pyridine nucleus, e.g., 3,3-dialkyl-3H-pyrrolo[2,3-b]pyridine such as 3,3-dimethyl-3H-pyrrolo[2,3-b]pyridine, 3,3-diethyl-3H-pyrrolo[2,3-b]pyridine, 1,3,3-trialkyl-3H-pyrrolo[2,3-b]pyridine such as 1,3,3-triethyl-3H-pyrrolo[2,3-b]pyridine, etc.); and a thiazole[4,5-b]quinoline nucleus; a pyrylium (including benzopyrylium, thiapyrylium and benzothiapyrylium) nucleus; and a dithiolinium nucleus. In the most preferred embodiment $Z_1$ represents the atoms necessary to form a pyridine or quinoline nucleus.

The above dyes, wherein $k$ represents O, preferably are prepared by reacting a heterocyclic salt of the formula:

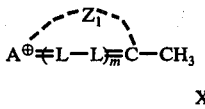

II.

with a nitro-substituted compound having the formula:

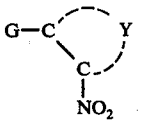

III.

In the above formulae II and III, $m$, A, $Z_1$, L, and Y have the same meaning as defined above, G represents a halide such as fluoride, chloride or bromide, and X represents an acid anion (e.g., halide such as chloride, bromide, or iodide, p-toluenesulfonate, thiocyanate, sulfamate, perchlorate fluoroborate, methylsulfonate, ethylsulfonate, fluorosulfonate, 2,4-dinitrobenzenesulfonate, etc.).

The preparation of dyes according to the description above is fully set out in Belgian Pat. No. 788,279. The use of the nitrobenzylidene dyes alone as energy-sensitive dyes in photothermographic elements containing no silver halide is described in copending application Ser. No. 689,326, filed May 24, 1976 entitled PHOTOGRAPHIC ELEMENTS COMPRISING AN ENERGY-SENSITIVE ORGANIC DYE AND PROCESS OF FORMING AN IMAGE WITH SAID ELEMENT by Goffe, Jenkins and Sturmer.

Examples of useful nitrobenzylidine dyes which can be used along with the dyes containing the substituted heterocyclic nitrogen atoms are 2-(2,4-Dinitrobenzylidene)-3-ethylbenzothiazoline

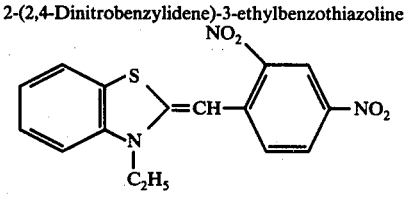

2-(2,4-Dinitrobenzylidene)-1,3-diethyl-1,2-dihydroimidazo-[4,5-b]quinoxaline

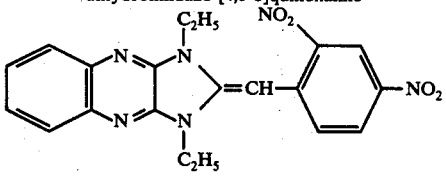

2-(2,4-Dinitrobenzylidene)-3-ethyl-2,3-dihydrothiazolo-[4,5-b]quinoline

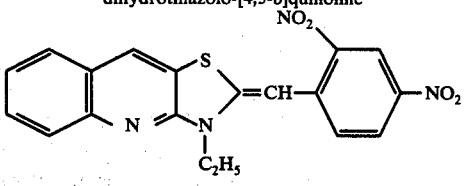

2-(2,4-Dinitrobenzylidene)-1,3,3-trimethylindoline

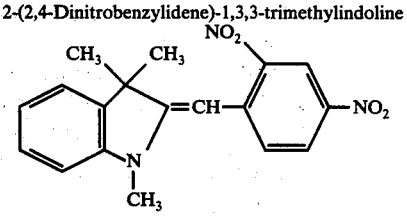

4-(2,4-Dinitrobenzylidene)-1-ethyl-1,4-dihydroquinoline

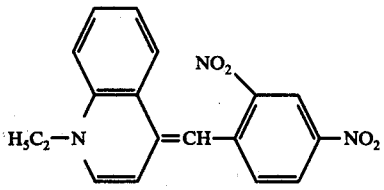

2-(2,4-Dinitrobenzylidene)-1,2-dihydro-1-(3-sulfopropyl)-quinoline, sodium salt

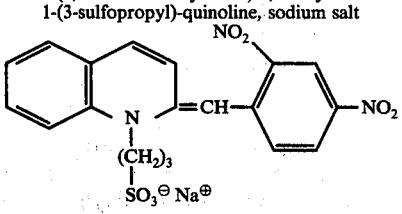

4-(2,4-Dinitrobenzylidene)-1,2-dihydro-1-(4-sulfobutyl)-quinoline, sodium salt

-continued

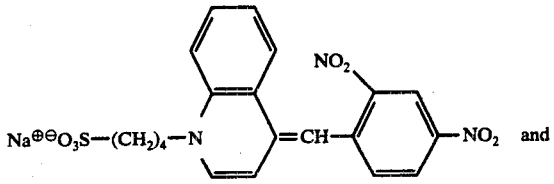

and 1,4-Dihydro-4-(2,4-dinitrobenzylidene)-1-octadecylquinoline

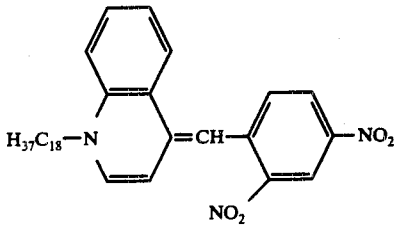

The photosensitive dye containing a heterocyclic nitrogen atom which is substituted by an alkoxy or acyloxy group typically can have one of the general formulae:

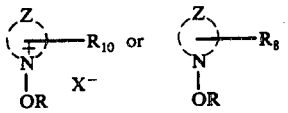

wherein:

$R_{10}$ can be any of the following:

(a) a methine linkage terminated by a heterocyclic nucleus of the type contained in cyanine dyes, e.g. those set forth in Mees and James, "The Theory of the Photographic Process," MacMillan, 3rd ed., pp. 198–232; the methine linkage can be substituted or unsubstituted, e.g., —CH=, —C($CH_3$)=, —C($C_6H_5$)=, —CH=•CH—, —CH=CH—CH—, etc.

(b) an alkyl radical preferably containing one to eight carbon atoms including a substituted alkyl radical;

(c) an aryl radical including a substituted aryl radical such as a phenyl radical, a naphthyl radical, a tolyl radical, etc.;

(d) hydrogen;

(e) an acyl radical having the formula

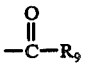

wherein $R_9$ is hydrogen or an alkyl group preferably having 1 to 8 carbon atoms;

(f) an anilinovinyl radical such as a radical having the formula

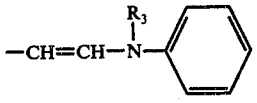

wherein $R_3$ is hydrogen, acyl or alkyl; or (g) a styryl radical including substituted styryl radicals, e.g.,

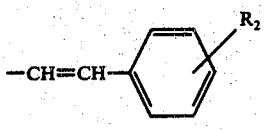

wherein $R_2$ is hydrogen, alkyl, aryl, amino including dialkylamino such as dimethylamino;

$R_8$ can be either of the following:

(a) a methine linkage terminated by a heterocyclic nucleus of the type contained in merocyanine dyes, e.g., those set forth in Mees and James (cited above); the methine linkage can be substituted or unsubstituted; or (b) an allylidene radical including a substituted allylidine radical such as a cyanoallylidine radical, an alkylcarboxy-allylidene radical or an alkylsulfonylallylidine radical;

R can be either:

(a) an alkyl radical preferably having one to eight carbon atoms such as methyl, propyl, ethyl, butyl, etc., including a substituted alkyl radical such as sulfoalkyl, e.g., —$(CH_2)_3$ $SO_3$—, an aralkyl, e.g., benzyl or pyridinatooxyalkyl salt, e.g., —$(CH_2)_3$—O—Q wherein Q is substituted or unsubstituted pyridinium salt; or (b) an acyl radical, e.g.,

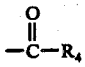

wherein $R_4$ is an alkyl radical preferably having one to eight carbon atoms or aryl radical, e.g., methyl, ethyl, propyl, butyl, phenyl, naphthyl, etc.

Z represents the atoms necessary to complete a 5- to 6-membered heterocyclic nucleus including a substituted heterocyclic nucleus which nucleus can contain at least one additional hetero atom such as oxygen, sulfur, selenium or nitrogen, e.g., a pyridine nucleus, a quinoline nucleus, etc.; and $X^-$ represents an acid anion, e.g., chloride, bromide, iodide, perchlorate, sulfamate, thiocyanate, p-toluenesulfonate, methylsulfate, tetrafluoroborate, etc.

The preferred sensitizing compounds have one of the following structures:

(A)

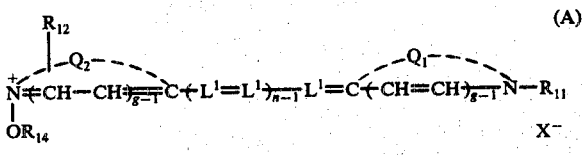

(B)

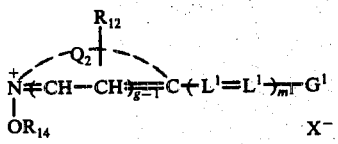

(C)

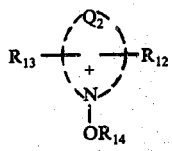

-continued

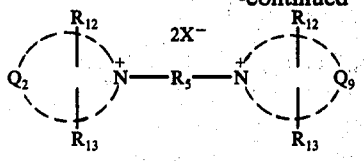

(D)

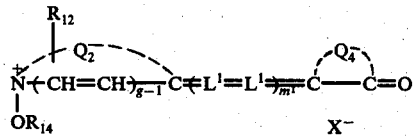

(E)

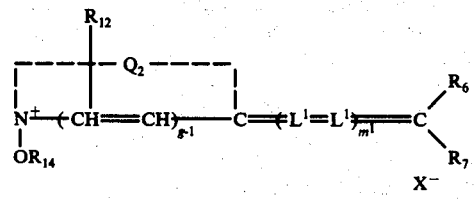

(F)

wherein $Q_1$, $Q_2$ and $Q_9$ each represent the nonmetallic atoms necessary to complete a sensitizing or desensitizing nucleus containing five or six atoms in the heterocyclic ring, which nucleus can contain at least one additional hetero atom such as oxygen, sulfur, selenium or nitrogen, i.e., a nucleus of the type used in the production of cyanine dyes, such as the following representative nuclei: a thiazole nucleus, e.g., thiazole, 4-methylthiazole, 3-ethylthiazole, 4-phenylthiazole, 5-methylthiazole, 5-phenylthiazole, 4,5-dimethylthiazole, 4,5-diphenylthiazole, 4-(2-thienyl)thiazole, benzothiazole, 4-chlorobenzothiazole, 4- or 5-nitrobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 6-nitrobenzothiazole, 5-bromobenzothiazole, 6-bromobenzothiazole, 5-chloro-6-nitrobenzothiazole, 4-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, a tetrahydrobenzothiazole nucleus, 5,6-dimethoxybenzothiazole, 5,6-methylenedioxybenzothiazole, 5-hydroxybenzothiazole, 6-hydroxybenzothiazole, α-naphthothiazole, β-naphthothiazole, β,β-naphthothiazole, 5-methoxy-β,β-naphthothiazole, 5-ethoxy-β-napthothiazole, 8-methoxy-α-naphthothiazole, 7-methoxy-α-naphthothiazole, 4″-methoxythianaptheno-7′,6′,4,5-thiazole, nitro group substituted naphthothiazoles, etc.; an oxazole nucleus, e.g., 4-methyloxazole, 4-nitro-oxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 5- or 6-nitrobenzoxazole, 5-chloro-6-nitrobenzoxazole, 6-methylbenzoxazole, 5,6-dimethylbenzoxazole, 4,6-dimethylbenzoxazole, 5-methoxybenzoxazole, 5-ethoxybenzoxazole, 5-chlorobenzoxazole, 6-methoxybenzoxazole, 5-hydroxybenzoxazole, 6-hydroxybenzoxazole, α-naphthoxazole, β-naphthoxazole, nitro group substituted naphthoxazoles, etc.; a selenazole nucleus, e.g., 4-methylselenazole, 4-nitroselenazole, 4-phenylselenazole, benzoselenazole, 5-chlorobenzoselenazole, 5-methoxybenzoselenazole, 5-hydroxybenzoselenazole, 5- or 6-nitrobenzoselenazole, 5-chloro-6-nitrobenzoselenazole, tetrahydrobenzoselenazole, α-naphthoselenazole, β-naphthoselenazole, nitro group substituted naphthoselenazoles, etc.; a thiazoline nucleus, e.g., thiazoline, 4-methylthiazoline, etc.; a pyridine nucleus, e.g., 2-pyridine, 5-methyl-2-pyridine, 4-pyridine, 3-methyl-4-pyridine, nitro group substituted pyridines, etc.; a quinoline nucleus, e.g., 2-quinoline, 3-methyl-2-quinoline, 5-ethyl-2-quinoline, 6-chloro-2-quinoline, 6-nitro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 6-nitro-4-quinoline, 7-methyl-4-quinoline, 8-chloro-4-quinoline, 1-isoquinoline, 6-nitro-1-isoquinoline, 3,4-dihydro-1-isoquinoline, 3-isoquinoline, etc.; a 3,3-dialkylindolenine nuclues, preferably having a nitro or cyano substituent, e.g., 3,3-dimethyl-5 or 6-nitroindolenine, 3,3-dimethyl-5- or 6-cyano-indolenine, etc.; and, an imidazole nuclues, e.g., imidazole, 1-alkylimidazole, 1-alkyl-4-phenylimidazole, 1-alkyl-4,5-dimethylimidazole, benzimidazole, 1-alkylbenzimidazole, 1-alkyl-5-nitrobenzimidazole, 1-aryl-5,6-dichlorobenzimidazole, 1-alkyl-α-naphthimidazole, 1-aryl-β-naphthimidazole, 1-alkyl-5-methoxy-α-naphthimidazole, or, an imidazo[4,5-b]quinoxaline nucleus, e.g., 1-alkylimidazo[4,5-b]quinoxaline such as 1-ethylimidazo[4,5-b]quinoxaline, 6-chloro-1-ethylimidazo[4,5-b]-quinoxaline, etc., 1-alkenylimidazo[4,5-b]-quinoxaline such as 1-allylimidazo[4,5-b]quinoxaline, 6-chloro-1-allylimidazo[4,5-b]quinoxaline, etc., 1-arylimidazo[4,5-b]quinoxaline, such as 1-phenylimidazo[4,5-b]quinoxaline, 6-chloro-1-phenylimidazo[4,5-b]quinoxaline, etc.; a 3,3-dialkyl-3-H-pyrrolo[2,3-b]pyridine nucleus, e.g., 3,3-dimethyl-3H-pyrrolo[2,3-b]pyridine, 3,3-diethyl-3H-pyrrolo[2,3-b]pyridine, etc.; a thiazolo[4,5-b]quinoline nucleus; $R_{11}$ represents an alkyl group, including substituted alkyl (preferably a lower alkyl containing from one to four carbon atoms), e.g., methyl, ethyl, propyl, isopropyl, butyl, hexyl, cyclohexyl, decyl, dodecyl, etc., and substituted alkyl groups (preferably a substituted lower alkyl containing from one to four carbon atoms), such as a hydroxyalkyl group, e.g., β-hydroxyethyl, ω-hydroxybutyl, etc., an alkoxyalkyl group, e.g., β-methoxyethyl, ω-butoxybutyl, etc., a carboxyalkyl group, e.g., β-carboxyethyl, ω-carboxybutyl, etc., an alkoxy group, e.g., methoxy, ethoxy, etc., a sulfoalkyl group, e.g., β-sulfoethyl, ω-sulfobutyl, etc., a sulfatoalkyl group, e.g., β-sulfatoethyl, ω-sulfatobutyl, etc., an acyloxyalkyl group, e.g., β-acetoxyethyl, γ-acetoxypropyl, ω-butyryloxybutyl, etc., an alkoxycarbonyl-alkyl group, e.g., β-methoxycarbonylethyl, ω-ethoxycarbonylbutyl, etc., or an aralkyl group, e.g., benzyl, phenethyl, etc.; an alkenyl group, e.g., allyl, 1-propenyl, 2-butenyl, etc., or an aryl group, e.g., phenyl, tolyl, naphthyl, methoxyphenyl, chlorophenyl, etc.; $Q_4$ represents the nonmetallic atoms required to complete a 5 to 6 membered heterocyclic nucleus, typically containing a hetero atom selected from nitrogen, sulfur, selenium, and oxygen, such as a 2-pyrazolin-5-one nucleus (e.g., 3-methyl-1-phenyl)-2-pyrazolin-5-one, 1-phenyl-2-pyrazolin-5-one, 1-(2-benzothiazolyl)-3-methyl-2-pyrazolin-5-one, etc.); an isoxazoline nucleus (e.g., 3-phenyl-5-(4H)-isoxazoline, 3-methyl-5-(4H)-isoxazolone, 3-methyl-5-(4H)-isoxazolone, etc.); an oxindole nucleus (e.g., 1-alkyl-2,3-dihydro-2-oxindoles, etc.), a 2,4,6-triketohexahydropyrimidine nucleus (e.g., barbituric acid or 2-thiobarbituric acid as well as their 1-alkyl (e.g., 1-methyl, 1-ethyl, 1-propyl, 1-heptyl, etc.) or 1,3-dialkyl (e.g., 1,3-dimethyl, 1,3-diethyl, 1,3-dipropyl, 1,3-diisopropyl, 1,3-dicyclohexyl, 1,3-di(β-methoxyethyl), etc.) or 1,3-diaryl (e.g., 1,3-diphenyl, 1,3-di(p-chlorophenyl), 1,3-di(p-ethoxycarbonylphenyl), etc.) or 1-aryl (e.g., 1-phenyl, 1-p-chlorophenyl, 1-p-ethoxycarbonylphenyl, etc.) or 1-alkyl-3-aryl (e.g., 1-ethyl-3-phenyl, 1-n-heptyl-3-phenyl, etc.) derivatives), a rhodanine nucleus (i.e., 2-thio-2,4-thiazolidinedione series), such as rhodanine, 3-alkylrhodanines (e.g., 3-ethylrhodanine, 3-allylrhodanine, etc.), 3-carboxyalkylrhodanines (e.g., 3-(2-carboxyethylrhodanine, 3-(4-carboxybutylrhodanine, etc.), 3-sulfoalkyl rhodanines (e.g., 3-(2-sulfoethyl)rhodanine, 3-(3-sulfopropyl)rhodanine, 3-(4-sulfobutyl)rhodanine, etc.), or 3-arylrhodanines (e.g., 3-phenylrhodanine, etc.), etc., a 2(3H)-imidazo[1,2-a]pyridone nucleus, a 2-furanone nucleus (e.g., 3-cyano-4-phenyl-2(5H)-furanone), a thiphen-3-one-1,1-dioxide nucleus (e.g., benzo-1[b]thiophen-3(2H)-one-1,1-dioxide); a 5,7-dioxo-6,7-dihydro-5-thiazolo[3,2-a]pyrimidine nucleus (e.g., 5,7-dioxo-3-phenyl-6,7-dihydro-5-thiazolo[3,2-a]pyrimidine, etc.), a 2-thio-2,4-oxazolidinedione nucleus (i.e., those of the 2-thio-2,4(3H, 5H)-oxazoledione series) (e.g., 3-ethyl-2-thio-2,4-oxazolidinedione, 3-(2-sulfoethyl)-2-thio-2,4-oxazolidinedione, 3-(4-sulfobutyl)-2-thio-2,4-oxazolidinedione, 3-(3-carboxypropyl)-2-thio-2,4-oxazolidinedione, etc.); a thianaphthenone nucleus (e.g., 2-(2H)-thianaphthenone, etc.); a 2-thio-2,5-thiazolidinedione nucleus (i.e., the 2-thio-2,5(3H, 4H)-thiazoledione series) (e.g., 3-ethyl-2-thio-2,5-thiazolidinedione, etc.); a 2,4-thiazolidinedione nucleus (e.g., 2,4-thiazolidinedione, 3-ethyl-2,4-thiazolidinedione, 3-phenyl-2,4-thiazolidinedione, 3-α-naphthyl-2,4-thiazolidinedione, etc.); a thiazolidinone nucleus (e.g., 4-thiazolidinone, 3-ethyl-4-thiazolidinone, 3-phenyl-4-thiazolidinone, 3-α-naphthyl-4-thiazolidinone, etc.); a 2-thiazolin-4-one series (e.g., 2-ethylmercapto-2-thiazolin-4-one, 2-alkylphenylamino-2-thiazolin-4-one, 2-diphenylamino-2-thiazoline-4-one, etc.); a 2-imino-4-oxyazolidinone (i.e., pseudohydantoin) nucleus, a 2,4-imidazolidinedione (hydantoin) series (e.g., a,4-imidazolidinedione, 3-ethyl-2,4-imidazolidinedione, 3-phenyl-2,4-imidazolidinedione, 3-α-naphthyl-2,4-imidazolidinedione, 1,3-diethyl-2,4-imidazolidinedione, 1-ethyl-3-phenyl-2,4-imidazolidinedione, 1-ethyl-2-α-naphthyl-2,4-imidazolidinedione, 1,3-diphenyl-2,4-imidazolidinedione, etc.); a 2-thio-2,4-imidazolidinedione (i.e. 2-thiohydantoin)nucleus (e.g., 2-thio-2,4-imidazolidinedione, 3-ethyl-2-thio-2,4-imidazolidinedione, 3-(4-sulfobutyl)-2-thio-2,4-imidazolidinedione, 3-(2-carboxyethyl)-2-thio-2,4-imidazolidinedione, 3-phenyl-2-thio-2,4-imidazolidinedione, 3-α-naphthyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-α-naphthyl-2-thio-2,4-imidazolidinedione, 1,3-diphenyl-2-thio-2,4-imidazolidinedione, etc.); a 2-imidazolin-5-one nucleus (e.g., 2-propylmercapto-2-imidazolin-5-one, etc.);

$n$ is a positive integer from 1 to 4;

$m^1$ is a positive integer from 1 to 3;

$g$ is a positive integer from 1 to 2;

$R_6$ and $R_7$ each represent a cyano radical, an ester radical such as ethoxycarbonyl, methoxycarbonyl, etc., or an alkylsulfonyl radical such as ethylsulfonyl, methylsulfonyl, etc.;

$L^1$ represents a methine linkage having the formula $$-\underset{\underset{T}{|}}{C}=$$

wherein T is hydrogen, lower alkyl of one to four carbon atoms or aryl such as phenyl, e.g., —CH=, —C(CH$_3$)=, —C(C$_6$H$_5$)=, etc.;

$R_{12}$ and $R_{13}$ each represent a hydrogen atom, an alkyl group (preferably a lower alkyl containing from one to four carbon atoms), e.g., methyl, ethyl, propyl, isopropyl, butyl, decyl, dodecyl, etc., or an aryl group, e.g., phenyl, tolyl, naphthyl, methoxyphenyl, chlorophenyl, nitrophenyl, etc.;

X represents an acid anion, e.g., chloride, bromide, iodide, perchlorate, tetrafluoroborate, sulfamate, thiocyanate, p-toluenesulfonate, methyl sulfate, etc.;

$G^1$ represents an anilino radical or an aryl radical, e.g., phenyl, naphthyl, dialkylaminophenyl, tolyl, chlorophenyl, nitrophenyl, anilinovinyl, etc.;

$R_5$ is an alkyleneoxy radical having one to eight carbon atoms in the alkylene chain including an alkylenedioxy radical and an arylenebisalkoxy radical e.g., ethyleneoxy, trimethyleneoxy, tetramethyleneoxy, propylideneoxy, ethylenedioxy, phenylene-bisethoxy, etc.;

$R_{14}$ represents either (1) an alkyl radical including a substituted alkyl (preferably a lower alkyl having one to four carbon atoms); e.g., methyl, ethyl, propyl, isopropyl, butyl, hexyl, cyclohexyl, decyl, dodecyl, aralkyl such as benzyl, sulfoalkyl such as β-sulfoethyl, ω-sulfobutyl, ω-sulfopropyl; or (2) an acyl radical, e.g., $$-\overset{\overset{O}{\|}}{C}-R_4$$

wherein $R_4$ is an alkyl including a substituted alkyl or an aryl radical such as methyl, phenyl, naphthyl, propyl, benzyl, etc.

In the above formulae $Q_2$ preferably completes a pyridine or a quinoline nucleus.

Typical sensitizing compounds included are the following:

1. 3-ethyl-1'-methoxyoxa-2'-pyridocarbocyanine perchlorate
2. 1'-ethoxy-3-ethyloxa-2'-pyridocarbocyanine tetrafluoroborate
3. 3'-ethyl-1-methoxy-2-pyridothiacyanine iodide
4. 1-ethoxy-3'-ethyl-2-pyridothiacyanine tetrafluoroborate
5. 1-benzyloxy-3'-ethyl-2-pyridothiacyanine iodide
6. 3'-ethyl-1-methoxy-2-pyridothiacarbocyanine iodide
7. 1-ethoxy-3'-ethyl-2-pyridothiacarbocyanine tetrafluoroborate
8. anhydro-3'-ethyl-1-(3-sulfopropoxy)-2-pyridothiacarbocyanine hydroxide
9. 1-benzyloxy-3'-ethyl-2-pyridothiacarbocyanine perchlorate
10. 3'-ethyl-1-methoxy-2-pyridothiacarbocyanine perchlorate
11. 1'-methoxy-3,3-trimethylindo-2'-pyridocarbocyanine picrate
12. 3'-ethyl-1-methoxy-4',5'-benzo-2-pyridothiacarbocyanine perchlorate
13. 1-ethoxy-3'-ethyl-4',5'-benzo-2-pyridothiacarbocyanine tetrafluoroborate
14. 1'-ethoxy-3-ethyloxa-2'-carbocyanine tetrafluoroborate
15. 1'-ethoxy-3-ethylthia-2'-cyanine tetrafluoroborate
16. 1'-ethoxy-3-ethylthia-2'-carbocyanine tetrafluoroborate
17. 1'-ethoxy-3-ethylthia-2'-dicarbocyanine tetrafluoroborate
18. 1-methoxy-3'-methyl-2-pyridothiazolinecarbocyanine perchlorate
19. 3'-ethyl-1-methoxy-4-pyridothiacyanine perchlorate
20. 3'-ethyl-1-methoxy-4-pyridothiacarbocyanine perchlorate 21. 1'-ethoxy-3-ethyl-4,5-benzothia-2'-carbocyanine tetrafluoroborate
22. 2-β-anilinovinyl-1-methoxypyridinium p-toluenesulfonate
23. 1-ethyl-1'-methoxy-4,5-benzothia-4'-carbocyanine perchlorate
24. 1-methoxy-2-methylpyridinium p-toluenesulfonate
25. 1-methoxy-4-methylpyridinium p-toluenesulfonate
26. anhydro-2-methyl-1-(3-sulfopropoxy)pyridinium hydroxide
27. 1-ethoxy-2-methylpyridinium tetrafluoroborate
28. 1-benzyloxy-2-methylpyridinium bromide
29. 1-ethoxy-2-methylquinolinium tetrafluoroborate
30. 1,1'-ethylenedioxybispyridinium dibromide
31. 1,1'-trimethylenedioxybispyridinium dibromide
32. 1,1'-tetramethylenedioxybis(2-methylpyridinium)dibromide
33. 1,1'-tetramethylenedioxybis(4-methylpyridinium)dibromide
34. 1,1'-tetramethylenedioxybispyridinium dibromide
35. 1,1'-pentamethylenedioxybispyridinium dibromide
36. 1-acetoxy-2-(4-dimethylaminostyryl)pyridinium perchlorate
37. 1-benzoyloxy-2-(4-dimethylaminostyryl)pyridinium perchlorate
38. 1,3-diethyl-5-[(1-methoxy-2(1H)-pyridylidene)ethylidene]-2-thiobarbituric acid
39. 3-ethyl-5-[(1-methoxy-2(1H)-pyridylidene)ethylidene]rhodanine
40. 1,3-diethyl-5-[(1-methoxy-2(1H)-pyridylidene)ethylidene]barbituric acid
41. 2-(3,3-dicyanoallylidene)-1-methoxy-1,2-dihydropyridine
42. 2-[(1-methoxy-2(1H)-pyridylidene)-ethylidene]benzo[b]-thiophen-3(2H)-one-1,1-dioxide
43. 3-cyano-5-[(1-methoxy-2(1H)-pyridylidene methylidene]-4-phenyl-2(5H)-furanone.

The preparation of these dyes according to the description given above is detailed in U.S. Pat. No. 3,649,275 issued Mar. 14, 1972 to McNally et al.

One embodiment of the invention is: in a non-silver halide photothermographic element comprising a support having thereon a catalyst, an oxidation-reduction image-forming combination comprising a heavy metal salt oxidizing agent with a non-radiation sensitive reducing agent and a binder; the improvement comprising the above mentioned combination of dyes as the catalyst. Each energy-sensitive dye is typically present in a photothermographic composition at a concentration range of from about $10^{-1}$ mole to about $10^{-5}$ mole of energy-sensitive dye per mole of silver in the silver salt oxidizing agent and preferably at a concentration range from about $10^{-2}$ mole to about $10^{-4}$ mole per mole of silver.

The photothermographic elements and compositions according to the invention comprises an oxidation-reduction image-forming combination which contains an oxidizing agent, preferably a heavy metal salt oxidizing agent. The heavy metal salt oxidizing agent can be a heavy metal salt of an organic acid such as a fatty acid which is resistant to darkening upon illumination. An especially useful class of heavy metal salts of organic acids is represented by the water insoluble silver salts of long-chain fatty acids which are stable to light. Compounds which are suitable silver salt oxidizing agents include silver behenate, silver stearate, silver oleate, silver laurate, silver hydroxystearate, silver caprate, silver myristate and silver palmitate. Silver salts can be employed as the heavy metal salt oxidizing agent which are not silver salts of long-chain fatty acids. Such silver salt oxidizing agents which are useful include, for example, silver benzoate, silver benzotriazole, silver terephthalate, silver phthalate and the like.

A range of organic non-radiation sensitive reducing agents such as bis-naphthol reducing agents can be employed in the practice of the invention to provide a desired developed image. These can be employed in combination, if desired, with other reducing agents. Suitable organic reducing agents which can be employed in the described combination include, for example, substituted phenols and naphthols.

The bis-nephthol which is preferred is a bis-β-naphthol of the formula:

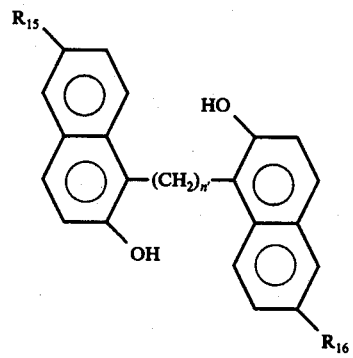

wherein $R_{15}$ and/or $R_{16}$ is hydrogen, alkyl with 1 to 3 carbon atoms, alkoxy, e.g. alkoxy containing 1 to 2 carbon atoms, such as methoxy or ethoxy; halogen, nitro, amino, or a diazonium halide salt and $n'$ is 0 or 1.

An especially suitable bis-β-naphthol is 1,1'-bi-2-naphthol of the formula:

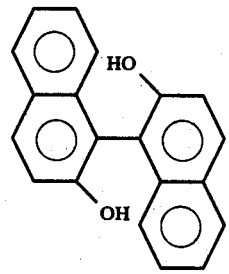

Other examples of suitable bis- -naphthols which can be employed in the practice of the invention include:

6,6'-dibromo-2,2'-dihydroxy-1,1'-binaphthyl
6,6'-dinitro-2,2'-dihydroxy-1,1'-dinaphthyl
bis-(2-hydroxy-1-naphthyl)methane.

The described reducing agents are suitable in a range of concentration; however, they are especially suitable at a concentration from about 0.1 to 0.75 mole of reducing agent per mole of silver in the silver salt oxidizing agent in an element as described.

Other non-light sensitive reducing agents can be used in lieu of or in conjunction with the above bis-naphthol reducing agents. These include, for example, polyhydroxybenzenes such as hydroquinone developing agents, e.g. hydroquinone, alkyl-substituted hydroquinones as exemplified by tertiary butylhydroquinone, methylhydroquinone, 2,5-dimethylhydroquinone and 2,6-dimethylhydroquinone; catechols and pyrogallol; halo-substituted hydroquinones such as chlorohydroquinones or dichlorohydroquinone; alkoxy-substituted hydroquinones such as methoxyhydroquinone or ethoxyhydroquinone; methylhydroxynaphthalene; phenylenediamine developing agents; methylgallate; aminophenol developing agents, such as 2,4-diaminophenols and methylaminophenols; ascorbic acid developing agents such as ascorbic acid, ascorbic acid ketals and ascorbic acid derivatives such as those described in U.S. Pat. No. 3,337,324 of Green, issued Aug. 22, 1967; hydroxylamine developing agents such as N,N'-di(2-ethoxyethyl)hydroxylamine; 3-pyrazolidone developing agents such as 1-phenyl-3-pyrazolidone and 4-methyl-4-hydroxymethyl-1-phenyl-3-pyrazolidone including those described in British Pat. No. 930,572 published July 3, 1963; hydroxytetronic acid, andhyroxygtetronimide developing agents; reductone developing agents such as anhydrodihydropyrrolidino hexose reductone; sulfonamidophenols such as described in U.S. Pat. No. 3,801,321 of Evans and McLaen; and the like.

Photothermographic elements and compositions can contain various colloids alone or in combination as binders. Suitable materials are typically hydrophobic but hydrophilic materials can also be employed. They are transparent or translucent and include both naturally-occurring substances such as proteins, for example, gelatin, gelatin derivatives, cellulose derivatives, polysaccharides such as dextran, gum arabic and the like; and synthetic polymeric substances such as water-soluble polyvinyl compounds like poly(vinyl pyrrolidone), acrylamide polymers and the like. Other synthetic polymeric compounds which can be employed include dispersed vinyl compounds such as in latex form and particularly those which increase dimensional stability of photographic materials. Suitable synthetic polymers include those described in U.S. Pat. No. 3,342,568 of Nottorf, issued July 28, 1964; U.S. Pat. No. 3,193,386 of White, issued July 6, 1965; U.S. Pat. No. 3,062,674 of Houck et al., issued Nov. 6, 1962; U.S. Pat. No. 3,220,844 of Houck et al., issued Nov. 30, 1965; U.S. Pat. No. 3,287,289 of Ream et al., issued Nov. 22, 1966; and U.S. Pat. No. 3,411,911 of Dykstra, issued Nov. 19, 1968. Effective polymers include water insoluble polymers of alkyl acrylates and methacrylates, acrylic acid, sulfoalkyl acrylates or methacrylates, and those which have crosslinking sites which facilitate hardening or curing as well as those having recurring sulfobetaine units as described in Canadian Pat. No. 774,054. Preferred high molecular weight materials and resins include poly(vinyl butyral), cellulose acetate butyrate, polymethyl methacrylate, poly(vinylpyrrolidone), ethyl cellulose, polystyrene, polyvinyl chloride, chlorinated rubber, polyisobutylene, butadiene-styrene copolymers, viny chloride-vinyl acetate copolymers, copolymers of vinyl acetate, vinyl chloride and maleic acid, polyvinyl alcohol, and high molecular weight ethylene oxide polymers.

It is often desirable to employ a so-called activator toning agent, also known as an accelerator-toning agent, in the photothermographic elements according to the invention to obtain a desired image. The activator toning agent is typically useful in a range of concentration, such as a concentration of about 0.10 moles to about 1.1 moles of activator toning agent per mole of oxidizing agent in the photothermographic element. A typical suitable activator-toning agent is a heterocyclic activator-toning agent containing at least one nitrogen atom as described in Belgian Pat. No. 766,590 issued June 15, 1971. Typical activator-toning agents include, for example, cyclic imides such as phthalimide, N-hydroxyphthalimide, N-hydroxy-1,8-naphthalimide, N-potassium phthalimide, N-mercury phthalimide, succinimide and/or N-hydroxysuccinimide. Other activator-toning agents which can be employed include phthalazinone, 2-acetylphthalazinone and the like.

An especially useful photothermographic element according to the invention comprises a support having thereon an oxidation-reduction image-forming combination comprising (1) 1,1'-bi-2-naphthol and (2) silver behenate, (a) a poly(vinyl butyral) binder, (b) phthalimide and (c) a combination of 4-(2,4-dinitrobenzylidene)-1-ethyl-1,4-dihydroquinoline and 2-$\beta$-anilinovinyl-1-methoxypyridinium, p-toluene sulfonate.

Photothermographic elements according to the invention can contain hardeners, antistatic layers, development modifiers that function as speed-increasing compounds, plasticizers and lubricants, coating aids, brighteners, spectral sensitizing dyes, absorbing and filter dyes, also as described in the *Product Licensing Index,* Volume 92, December 1971, publication 9232, pp. 107–110.

Another embodiment of the invention is a photothermographic composition comprising (a) an oxidation-reduction image-forming combination comprising (1) a silver salt oxidizing agent with (2) a bis-beta-naphthol reducing agent, (b) a binder, as described, such as poly(vinyl butyral) and (c) a combination of dyes comprising (i) a photosensitive reducing agent precursor having an o-nitro substituted aryl group joined through a methine chain linkage to a basic heterocyclic nucleus containing an electron-donating nitrogen, oxygen or sulfur atom, and (ii) a photosensitive dye containing a heterocyclic nitrogen atom which is substituted by a member selected from the group consisting of an alkoxy group and an acyloxy group.

The photothermographic compositions and other compositions according to the invention can be coated on a suitable support by various coating procedures including dip coating, air knife coating, curtain coating or extrusion coating using hoppers such as described in U.S. Pat. No. 2,681,294 of Beguin, issued June 15, 1954. If desired, two or more layers can be coated simultaneously such as described in U.S. pat. No. 2,761,791 of Russell, issued Sept. 4, 1956 and British Pat. No. 837,095.

After exposure of the described photothermographic element according to the invention, typically to visible light, the resulting latent image can be developed to a negative image merely by overall heating the element to moderately elevated temperatures. This merely involves heating the described photothermographic element overall to a temperature within the range of about 80° C to about 250° C such as for about 0.5 seconds to about 60 seconds. By increasing or decreasing the length of time of heating, a higher or lower temperature within the described range can be employed depending upon the desired image. A developed image is typically produced within several seconds, such as about 0.5 seconds to about 60 seconds. A processing temperature within the range of about 110° C to about 165° C is especially useful.

Any suitable means can be used for providing the desired processing temperature. The heating means can be a simple hot plate, iron, roller or the like.

Processing is usually carried out under ambient conditions of pressure and humidity. Conditions outside normal atmospheric pressure and humidity can be employed, if desired.

If desired, the photothermographic elements of this invention for producing a negative image can be simultaneously exposed and heat processed to development.

The photothermographic compositions and elements of this invention are especially useful in that not only can a negative image be derived therefrom, but a positive image can be derived from the same elements by simply, after imagewise exposure of the photothermographic element to ultraviolet light, overall exposing the photothermographic element to tungsten light, or other light in the spectral region in which the nitrobenzylidene dye absorbs and then overall heating the photothermographic element to a temperature within the range from about 80° C to about 250° C for a time of from about 0.5 second to about 60 seconds. The necessary time of exposure to the tungsten lamp generally is from about 5 to about 15 seconds.

The following examples are included for a further understanding of the invention.

EXAMPLE 1

Dispersion A

A silver behenate dispersion was prepared by ball-milling the following composition for about 72 hours:

| | |
|---|---|
| Silver behenate | 168 grams |
| Poly(vinyl butyral) | 120 grams |
| Acetone-toluene (1:1 parts by volume) | 1600 mls |

A photothermographic element was prepared by coating the following composition on a photographic paper support at a wet thickness of 0.1 mm.

| | |
|---|---|
| Dispersion A | 11.4 ml |
| 1,1'-bi-2-naphthol(6.3% by weight in acetone) | 4.3 ml |
| phthalimide (5.0% by weight in acetone | 4.3 ml |
| 4-(2,4-dinitrobenzylidene)-1-ethyl-1,4-dihydroquinoline (1 milligram per milliliter of acetone) | 5.0 ml |

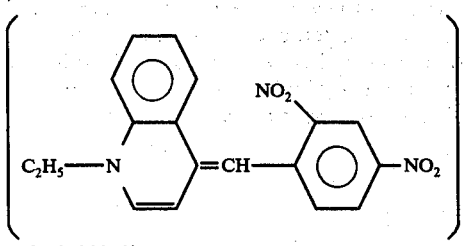

| | |
|---|---|
| 1'-ethoxy-3-ethylthia-2'-pyridocyanine tetrafluoroborate (1 milligram per milliliter of acetone) | 5.0 ml |

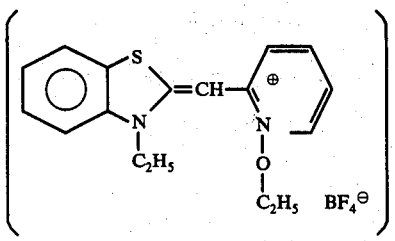

The photothermographic element was imagewise exposed for 15 seconds to ultraviolet light and then overall exposed to a filtered (Kodak Wratten 25) No. 2 photoflood lamp for 10 seconds. The exposed sample was overall heat processed for 20 seconds on a curved hot block at a temperature of about 122° C. A positive image resulted.

EXAMPLE 2

A photothermographic element was prepared by coating the following composition on a photographic paper support at a wet thickness of 0.1 mm.

| | |
|---|---|
| Dispersion A of Example 1 | 11.4 ml |
| 1,1'-bi-2-naphthol (6.3% by weight in acetone) | 4.3 ml |
| phthalimide (5.0% by weight in acetone) | 4.3 ml |
| 4-(2,4-dinitrobenzylidene)-1-ethyl-1,4-dihydroquinoline (1 milligram per milliliter of acetone) | 5.0 ml |
| 2-β-anilinovinyl-1-methoxy-pyridinium p-toluenesulfonate (1 milligram per milliliter of acetone) | 5.0 ml |

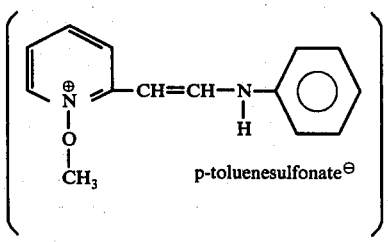

The photothermographic element was imagewise exposed for 15 seconds to ultraviolet light and then overall exposed to a filtered (Kodak Wratten 25) number 2 photoflood lamp for 10 seconds. The exposed sample was overall heat processed for 20 seconds on a curved hot block at a temperature of about 122° C. A positive image resulted.

EXAMPLE 3

A photothermographic element was prepared by coating the following composition on a photographic paper support at a wet thickness of 0.1 mm:

| | |
|---|---|
| silver behenate Dispersion A of Example 1 | 8.7 ml |
| 1,1'-bi-2-naphthol (6.3% by weight in acetone) | 3.3 ml |
| phthalimide (5.0% by weight in acetone | 3.3 ml |
| 4-(2,4-dinitrobenzylidene)-1-ethyl-1,4-dihydroquinoline (1 milligram per milliliter of acetone) | 4.7 ml |
| 2-β-anilinovinyl-1-methoxy-pyridinium p-toluenesulfonate (1 milligram per milliliter of acetone) | 10.0 ml |

A sample of the photothermographic element was exposed for $10^{-4}$ seconds to a xenon arc flash and heat processed for about 20 seconds on a curved hot block at a temperature of 120° C. A negative image resulted.

A further sample of the unexposed photothermographic element was imagewise exposed for 15 seconds to an ultraviolet light and then overall exposed to a number 2 filtered (Kodak Wratten 25) photoflood lamp for 10 seconds to give a red exposure. The sample was then overall heat processed for 20 seconds on a curved hot block at a temperature of 120° C. A positive image resulted.

The invention has been described in detail with particular reference to preferred embodiments thereof, but it will be understood that variations and modifications can be effected within the spirit and scope of the invention.

What is claimed is:

1. A non-silver halide photothermographic element comprising a support having thereon a layer comprising
   a) an oxidation-reduction image-forming combination comprising
      i) a non-radiation sensitive reducing agent and
      ii) an organic acid silver salt oxidizing agent,
   b) a binder, and
   c) a combination of energy-sensitive organic dyes which upon exposure to actinic radiation catalyze the reduction of the silver compound to metallic silver said combination comprising
      (i) a photosensitive reducing agent precursor having an o-nitro substituted aryl group joined through a methine chain linkage to a basic heterocyclic nucleus containing an electron-donating nitrogen, oxygen or sulfur atom, and
      (ii) a photosensitive dye containing a heterocyclic nitrogen atom which is substituted by a member selected from the group consisting of an alkoxy group and an acyloxy group.

2. A non-silver halide photothermographic element as in claim 1 also comprising an activator-toning agent.

3. A non-silver halide photothermographic element as in claim 1 containing an activator-toning agent which is a cyclic imide.

4. A non-silver halide photothermographic element as in claim 1 comprising an activator-toning agent which is phthalimide.

5. A non-silver halide photothermographic element as in claim 1 wherein said reducing agent is a bis-beta-naphthol.

6. A non-silver halide photothermographic element as in claim 5 wherein said bis-beta-naphthol reducing agent is 1,1'-bi-2-naphthol.

7. A non-silver halide photothermographic element as in claim 1 comprising about $10^{-1}$ to about $10^{-5}$ mole of each energy sensitive organic dye per mole of silver and from about 0.1 to about 0.75 mole of non-radiation sensitive reducing agent per mole of silver.

8. A non-silver halide photothermographic element comprising a support having thereon a layer comprising
   a) an oxidation-reduction image-forming combination comprising
      i) a non-radiation sensitive reducing agent, and
      ii) an organic acid silver salt oxidizing agent,
   b) a binder, and
   c) a combination of energy-sensitive organic dyes comprising
      (i) a photosensitive reducing agent precursor having an o-nitro-substituted aryl group joined through a methine chain linkage to a basic heterocyclic nucleus containing an electron-donating nitrogen, oxygen or sulfur atom, and
      (ii) a photosensitive dye having the formula selected from the group consisting of

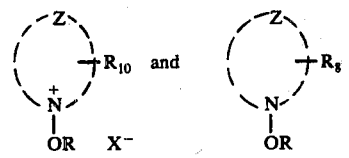

wherein:

$R_{10}$ is selected from the group consisting of:
   a. a methine linkage terminated by a heterocyclic nucleus of the type contained in cyanine dyes,
   b. alkyl,
   c. anilinovinyl,
   d. hydrogen,
   e. aryl,
   f. an aldehyde group, and
   g. a styryl radical;

$R_8$ is selected from the group consisting of:
   a. a methine linkage terminated by a heterocyclic nucleus of the type contained in merocyanine dyes and
   b. an allylidene radical;

R is selected from the group consisting of:
   a. alkyl, and
   b. acyl;

$X^-$ is an acid anion; and

Z represents the atoms necessary to complete a 5 to 6 membered heterocyclic nucleus.

9. A non-silver halide photothermographic element as in claim 8 wherein dye (ii) has the formula selected from the group consisting of

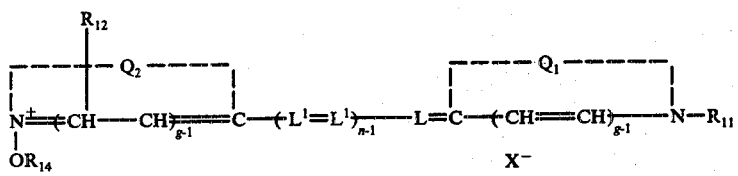

(A)

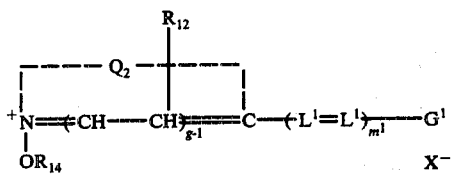

(B)

-continued (C)

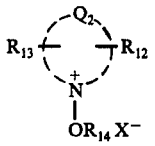

(D)

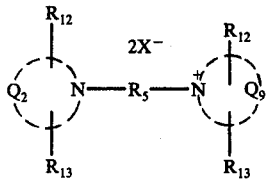

(E)

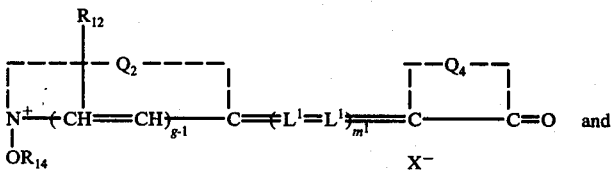

and (F)

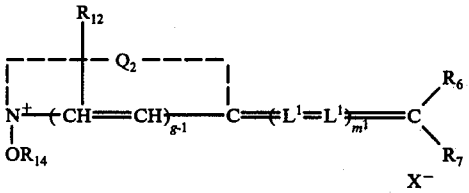

wherein:

$Q_1$, $Q_2$, $Q_4$ and $Q_9$ each represent the nonmetallic atoms necessary to complete a 5 to 6 membered heterocyclic nucleus;

$n$ is a positive integer from 1 to 4;

$m^1$ is a positive integer from 1 to 3;

$R_5$ is an alkyleneoxy radical having one to eight carbon atoms in the alkylene chain;

$g$ is a positive integer from 1 to 2;

$X^-$ is an acid anion;

$L^1$ is a methine linkage;

$R_{14}$ is selected from the group consisting of alkyl and acyl;

$R_{12}$ and $R_{13}$ are each selected from the group consisting of aryl, hydrogen and alkyl;

$R_{11}$ is selected from the group consisting of alkyl, alkenyl, aryl and alkoxy;

$G^1$ is selected from the group consisting of an anilinovinyl radical and aryl; and $R_6$ and $R_7$ are each a cyano radical, an ester radical, or an alkylsulfonyl radical.

10. A non-silver halide photothermographic element as in claim 8 wherein Z represents the atoms necessary to complete a member selected from the group consisting of a pyridine nucleus and a quinoline nucleus.

11. A non-silver halide photothermographic element as in claim 8 wherein the non-radiation sensitive reducing agent is a bis-beta naphthol.

12. A non-silver halide photothermographic element comprising a support having thereon a layer comprising a) an oxidation-reduction image-forming combination comprising i) a non-radiation sensitive reducing agent and ii) an organic acid silver salt oxidizing agent, b) a binder, and c) a combination of energy-sensitive organic dyes comprising i) a photosensitive reducing agent precursor having the formula

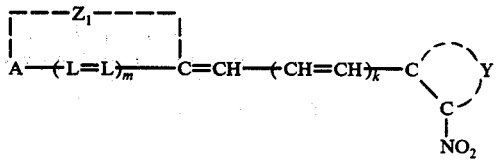

wherein:

(a) k represents 0 or 1;

(b) m represents 0 or 1;

(c) each L represents a methine group;

(d) A represents oxygen, sulfur or N—$R_1$;

(e) $R_1$ represents alkyl, alkenyl or aryl;

(f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms; and (g) Y represents the atoms necessary to complete a phenyl or naphthyl group; and ii) a dye having the formula selected from the group consisting of (A)

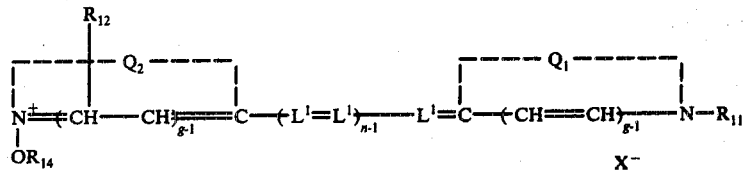

(B)

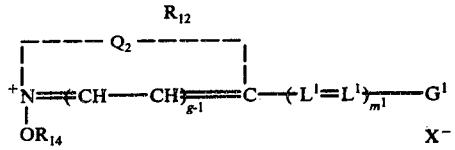

(C)

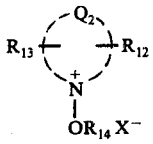

(D)

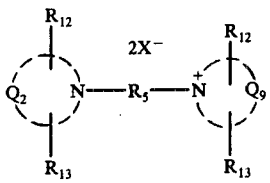

(E)

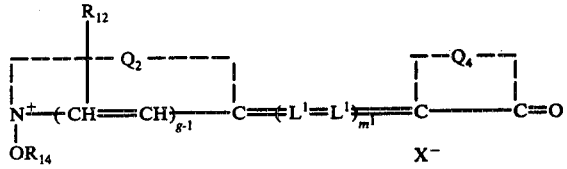

and (F)

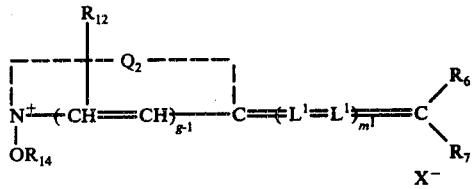

wherein:

$Q_1$, $Q_2$, $Q_4$ and $Q_9$ each represent the nonmetallic atoms necessary to complete a 5 to 6 membered heterocyclic nucleus;

$n$ is a positive integer from 1 to 4;

$m^1$ is a positive integer from 1 to 3;

$R_5$ is an alkyleneoxy radical having one to eight carbon atoms in the alkylene chain;

$g$ is a positive integer from 1 to 2;

$X^-$ is an acid anion;

$L^1$ is a methine linkage;

$R_{14}$ is selected from the group consisting of alkyl and acyl;

$R_{12}$ and $R_{13}$ are each selected from the group consisting of aryl, hydrogen and alkyl;

$R_{11}$ is selected from the group consisting of alkyl, alkenyl, aryl and alkoxy;

$G^1$ is selected from the group consisting of an anilinovinyl radical and aryl; and $R_6$ and $R_7$ are each a cyano radical, an ester radical, or an alkylsulfonyl radical.

13. A non-silver halide photothermographic element as in claim 12 also comprising an activator-toning agent.

14. A non-silver halide photothermographic element as in claim 12 also comprising an activator-toning agent which is a cyclic imide.

15. A non-silver halide photothermographic element as in claim 12 also comprising an activator-toning agent which is phthalimide.

16. A non-silver halide photothermographic element as in claim 12 wherein said non-radiation sensitive reducing agent is a bis-beta naphthol.

17. A non-silver halide photothermographic element as in claim 16 wherein said bis-beta naphthol is 1,1'-bi-2-naphthol.

18. A non-silver halide photothermographic element as in claim 12 comprising about $10^{-1}$ to about $10^{-5}$ mole of each energy-sensitive organic dye per mole of silver and from about 0.1 to about 0.75 mole of reducing agent per mole of silver.

19. A non-silver halide photothermographic element comprising a support having thereon a layer comprising a) an oxidation-reduction image-forming combination comprising
   i) 1,1'-bi-2-naphthol, and
   ii) silver behenate, b) a binder, and c) a combination of energy-sensitive organic dyes comprising
   i) a photosensitive reducing agent precursor having the formula ii) a dye having the formula selected from the group consisting of (A)

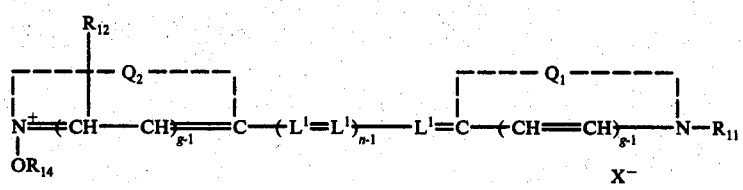

(B)

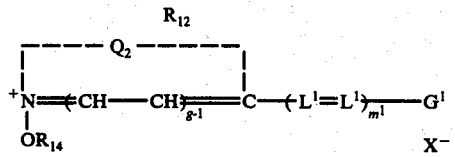

(C)

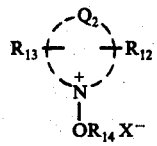

(D)

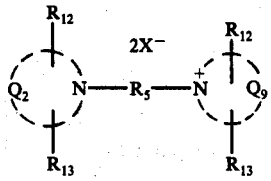

(E)

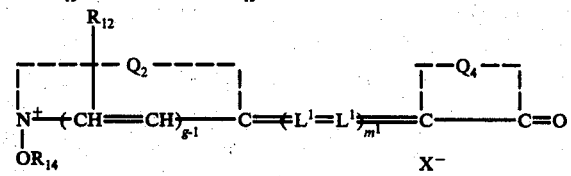

and (F)

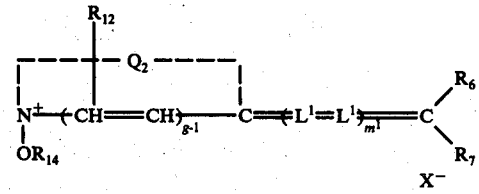

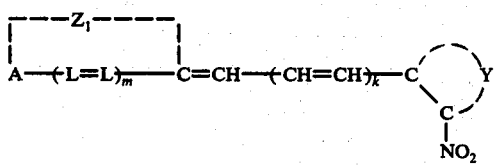

wherein:

(a) k represents 0 or 1;
(b) m represents 0 or 1;
(c) each L represents a methine group;
(d) A represents oxygen, sulfur or N—$R_1$;
(e) $R_1$ represents alkyl, alkenyl or aryl;
(f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms; and
(g) Y represents the atoms necessary to complete a phenyl or naphthyl group; and wherein:

$Q_1$, $Q_2$, $Q_4$ and $Q_9$ each represent the nonmetallic atoms necessary to complete a 5 to 6 membered heterocyclic nucleus;
$n$ is a positive integer from 1 to 4;
$m^1$ is a positive integer from 1 to 3;
$R_5$ is an alkyleneoxy radical having one to eight carbon atoms in the alkylene chain;
$g$ is a positive integer from 1 to 2;
$X^-$ is an acid anion;
$L^1$ is a methine linkage;
$R_{14}$ is selected from the group consisting of alkyl and acyl;
$R_{12}$ and $R_{13}$ are each selected from the group consisting of aryl, hydrogen and alkyl;
$R_{11}$ is selected from the group consisting of alkyl, alkenyl, aryl and alkoxy;
G is selected from the group consisting of an anilinovinyl radical and aryl; and
$R_6$ and $R_7$ are each a cyano radical, an ester radical, or an alkylsulfonyl radical.

20. A non-silver halide photothermographic element comprising a support having thereon a layer comprising a) an oxidation-reduction image-forming combination comprising
   i) 1,1'-bi-2-naphthol, and
   ii) silver behenate,
b) poly(vinyl butyral),
c) phthalimide, and
d) a combination of 4-(2,4-dinitrobenzylidene)-1-ethyl-1,4-dihydroquinoline and 2-β-anilinovinyl-1-methoxypyridinium p-toluenesulfonate.

21. A non-silver halide photothermographic element as in claim 20 comprising about $10^{-1}$ to about $10^{-5}$ mole of each energy-sensitive organic dye per mole of silver and from about 0.1 to about 0.75 mole of 1,1'-bi-2-naphthol per mole of silver.

22. A non-silver halide photothermographic composition comprising
a) an oxidation-reducting image-forming combination comprising
   i) a non-radiation sensitive reducing agent and
   ii) an organic acid silver salt oxidizing agent,
b) a binder, and
c) a combination of energy-sensitive organic dyes which upon exposure to actinic radiation catalyze the reduction of the silver compound to metallic silver said combination comprising
   (i) a photosensitive reducing agent precursor havomg an o-nitro substituted aryl group joined through a methine chain linkage to a basic heterocyclic nucleus containing an electron-donating nitrogen, oxygen or sulfur atom, and
   (ii) an photosensitve compound containing a heterocyclic nitrogen atom which is substituted by a member selected from the group consisting of an alkoxy group and an acyloxy group.

23. A non-silver halide photothermographic composition as in claim 22 also comprising an activator-toning agent.

24. A non-silver halide photothermographic composition as in claim 22 also comprising an activator-toning agent which is a cyclic imide.

25. A non-silver halide photothermographic composition as in claim 22 also comprising an activator-toning agent which is phthalimide.

26. A non-silver halide photothermographic composition as in claim 22 wherein said non-radiation sensitive reducing agent is a bis-beta naphthol.

27. A non-silver halide photothermographic composition as in claim 26 wherein said bis-beta naphthol is 1,1'-bi-2-naphthol.

28. A non-silver halide photothermographic composition as in claim 22 comprising about $10^{-1}$ to about $10^{-5}$ mole of each energy-sensitive organic dye per mole of silver and from about 0.1 to about 0.75 mole of reducing agent per mole of silver.

29. A non-silver halide photothermographic composition comprising
a) an oxidation-reduction image-forming combination comprising
   i) a non-radiation sensitive reducing agent and
   ii) an organic acid silver salt oxidizing agent,
b) a binder, and
c) a combination of energy-sensitive organic dyes comprising
   i) a photosensitive reducing agent precursor having the formula

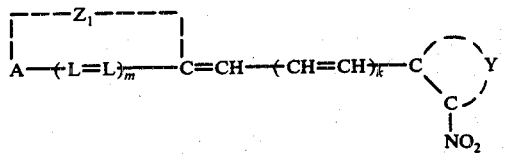

wherein:
(a) $k$ represents 0 or 1;
(b) $m$ represents 0 or 1;
(c) each L represents a methine group;
(d) A represents oxygen, sulfur or N—$R_1$;
(e) $R_1$ represents alkyl, alkenyl or aryl;
(f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms; and
(g) Y represents the atoms necessary to complete a phenyl or naphthyl group; and
   ii) a dye having the formula selected from the group consisting of (A)

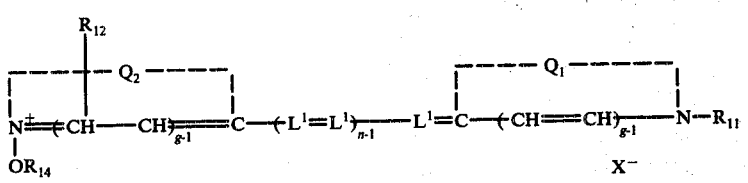

(B)

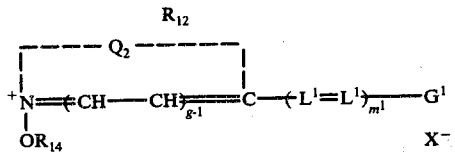

(C)

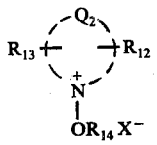

-continued

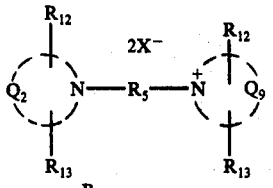

(D)

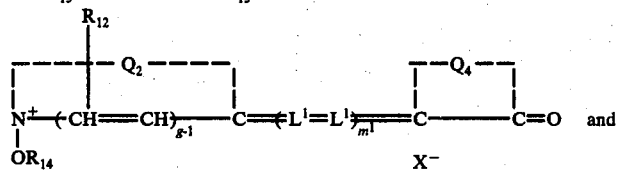

(E)

and

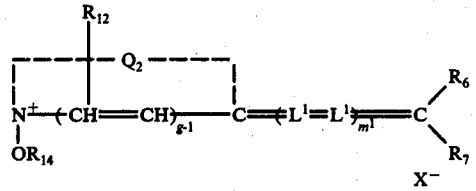

(F)

wherein:

$Q_1$, $Q_2$, $Q_4$ and $Q_9$ each represent the nonmetallic atoms necessary to complete a 5 to 6 membered heterocyclic nucleus;

$n$ is a positive integer from 1 to 4;

$m^1$ is a positive integer from 1 to 3;

$R_5$ is an alkyleneoxy radical having one to eight carbon atoms in the alkylene chain;

$g$ is a positive integer from 1 to 2;

$X^-$ is an acid anion;

$L^1$ is a methine linkage;

$R_{14}$ is selected from the group consisting of alkyl and acyl;

$R_{12}$ and $R_{13}$ are each selected from the group consisting of aryl, hydrogen and alkyl;

$R_{11}$ is selected from the group consisting of alkyl, alkenyl, aryl and alkoxy;

G is selected from the group consisting of an anilinovinyl radical and aryl; and $R_6$ and $R_7$ are each a cyano radical, an ester radical, or an alkylsulfonyl radical.

30. A non-silver halide photothermographic composition as in claim 29 wherein said non-radiation sensitive reducing agent is a bis-beta naphthol.

31. A non-silver halide photothermographic composition as in claim 30 wherein said bis-beta naphthol is 1,1'-bi-naphthol.

32. A non-silver halide photothermographic composition as in claim 29 comprising about $10^{-1}$ to about $10^{-5}$ mole of each energy-sensitive organic dye per mole of silver and from about 0.1 to about 0.75 mole of reducing agent per mole of silver.

33. A non-silver halide photothermographic composition as in claim 29 wherein the combination of energy-sensitive organic dyes comprises from about $10^{-1}$ to about $10^{-5}$ mole of dye i and from about $10^{-1}$ to about $10^{-5}$ mole of dye ii per mole or silver in said silver salt oxidizing agent.

34. A non-silver halide photothermographic composition comprising a) an oxidation-reduction image-forming combination comprising
   i) 1,1'-bi-2-naphthol, and
   ii) silver behenate, b) poly(vinyl butyral), c) phthalimide, and d) a combination of 4-(2,4-dinitrobenzylidene)-1-ethyl-1,4-dihydroquinoline and 2-$\beta$-anilinovinyl-1-methoxypyridinium p-toluenesulfonate.

35. A non-silver halide photothermographic composition as in claim 34 comprising about $10^{-1}$ to about $10^{-5}$ mole of each energy-sensitive organic dye per mole of silver and from 0.1 to about 0.75 mole of 1,1'-bi-2-naphthol per mole of silver.

36. A process of developing a negative latent image in an exposed non-silver halide photothermographic element comprising a support having thereon a layer comprising a) an oxidation-reduction image-forming combination comprising
   i) a non-radiation sensitive reducing agent and
   ii) an organic acid silver salt oxidizing agent, b) a binder, and c) a combination of energy-sensitive organic dyes which upon exposure to actinic radiation catalyze the reduction of the silver compound to metallic silver said combination comprising
   (i) a photosensitive reducing agent precursor having an o-nitro substituted aryl group joined through a methine chain linkage to a basic heterocyclic nucleus containing an electron-donating nitrogen, oxygen or sulfur atom, and
   (ii) a photosensitive compound containing a heterocyclic nitrogen atom which is substituted by a member selected from the group consisting of an alkoxy group an an acyloxy group comprising heating said element to from abut 80° C to about 250° C over a period of about 0.5 second to about 60 seconds.

37. A process of developin a negative latent image in an exposed non-silver halide photothermographic element comprising a support having thereon a layer comprising a) an oxidation-reduction image-forming combination comprising
   i) a non-radiation sensitive reducing agent and
   ii) an organic acid silver salt oxidizing agent, b) a binder, and c) a combination of energy-sensitive organic dyes comprising i) a photosensitive reducing agent precursor having the formula

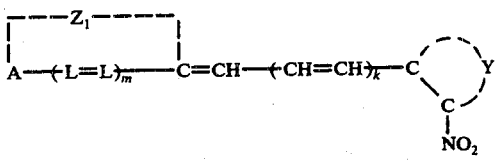

wherein:

(a) $k$ represents 0 or 1;
(b) $m$ represents 0 or 1;
(c) each L represents a methine group;
(d) A represents oxygen, sulfur or N—$R_1$;
(e) $R_1$ represents alkyl, alkenyl or aryl;
(f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms; and
(g) Y represents the atoms necessary to complete a phenyl or naphthyl group; and ii) a dye having the formula selected from the group consisting of (A)

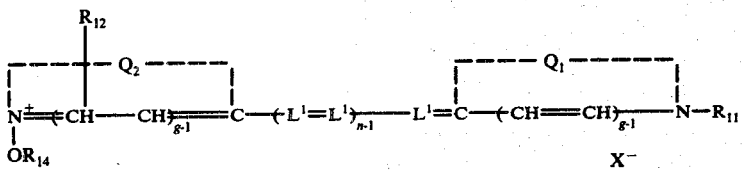

(B)

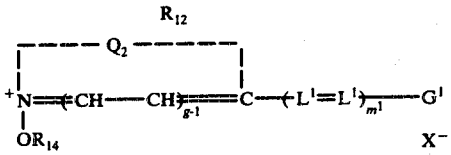

(C)

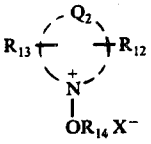

(D)

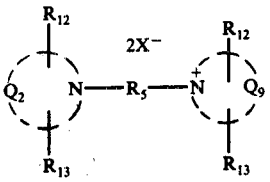

(E)

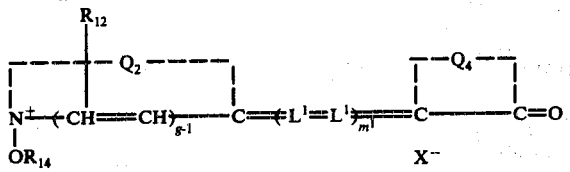

and (F)

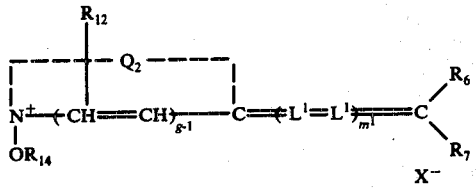

wherein:

$Q_1$, $Q_2$, $Q_4$ and $Q_9$ each represent the nonmetallic atoms necessary to complete a 5 to 6 membered heterocyclic nucleus;
$n$ is a positive integer from 1 to 4;
$m^1$ is a positive integer from 1 to 3;
$R_5$ is an alkyleneoxy radical having one to eight carbon atoms in the alkylene chain;
$g$ is a positive integer from 1 to 2;
$X^-$ is an acid anion;
$L^1$ is a methine linkage;
$R_{14}$ is selected from the group consisting of alkyl and acyl;
$R_{12}$ and $R_{13}$ are each selected from the group consisting of aryl, hydrogen and alkyl;
$R_{11}$ is selected from the group consisting of alkyl, alkenyl, aryl and alkoxy;
G is selected from the group consisting of an anilinovinyl radical and aryl; and
$R_6$ and $R_7$ are each a cyano radical, an ester radical, or an alkylsulfonyl radical, comprising heating said element to from about 80° C to about 250° C over a period of about 0.5 second to about 60 seconds.

38. A process of developing a negative latent image in an exposed non-silver halide photothermographic element comprising a support a) an oxidation-reduction image-forming combination comprising
   i) 1,1′-bi-2-naphthol, and
   ii) silver behenate,
b) poly(vinyl butyral),
c) phthalimide, and
d) a combination of 4-(2,4-dinitrobenzylidene)-1-ethyl-1,4-dihydroquinoline and 2 -β-anilinovinyl-1-methoxypyridinium p-toluenesulfonate;

comprising heating said element to from about 80° C to about 250° C over a period of about 0.5 second to about 60 seconds.

39. A process of developing a negative latent image as in claim 38 wherein the non silver halide photothermographic element comprises about $10^{-1}$ to about $10^{-5}$ mole of each energy-sensitive organic dye per mole of reducing agent per mole of silver, comprising heating said element to from about 80° C to about 250° C over a period of about 0.5 second to about 60 seconds.

40. A process of developing a positive latent image comprising respectively 1) imagewise exposing a non-silver halide photothermographic element comprising a support having thereon a layer comprising
   a) an oxidation-reduction image-forming combination comprising
      i) a non-radiation sensitive reducing agent and
      ii) an organic acid silver salt oxidizing agent,
   b) a binder, and
   c) a combination of energy-sensitive organic dyes which upon exposure to ultraviolet radiation catalyze the reduction of the silver compound to metallic silver said combination comprising
      (i) a photosensitive reducing agent precursor having an o-nitro substituted aryl group joined through a methine chain linkage to a basic heterocyclic nucleus containing an electron-donating nitrogen, oxygen or sulfur atom, and
      (ii) a photosensitive compound containing a heterocyclic nitrogen atom which is substituted by a member selected from the group consisting of an alkoxy group and an acyloxy group, to ultraviolet radiation,
2) overall exposing the photothermographic element to light in the spectral region in which the precursor (i) absorbs, and
3) overall heating the photothermographic element to from about 80° C to about 250° C for a time of about 0.5 second to about 60 seconds.

41. A process of developing a positive latent image comprising 1) imagewise exposing a non-silver halide photothermographic element comprising a support having thereon a layer comprising
   a) an oxidation-reduction image-forming combination comprising
      i) a non-radiation sensitive reducing agent and
      ii) an organic acid silver salt oxidizing agent,
   b) a binder, and
   c) a combination of energy-sensitive organic dyes comprising
      i) a photo-sensitive reducing agent precursor having the formula

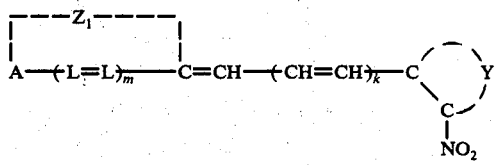

wherein:

(a) k represents 0 or 1;
(b) m represents 0 or 1;
(c) each L represents a methine group;
(d) A represents oxygen, sulfur or N—$R_1$;
(e) $R_1$ represents alkyl, alkenyl or aryl;
(f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms; and
(g) Y represents the atoms necessary to complete a phenyl or naphthyl group; and
   ii) a dye having the formula selected from the group consisting of

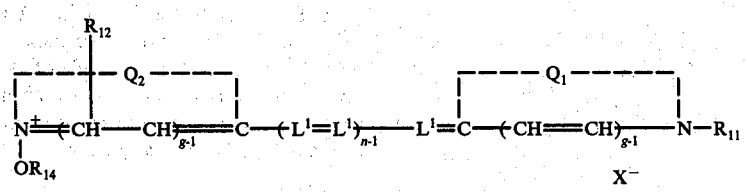

(A)

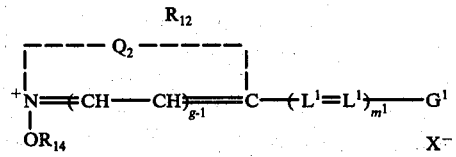

(B)

-continued (C)

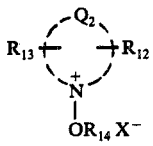

(D)

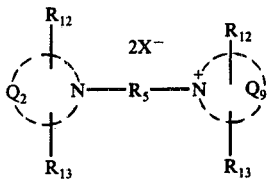

(E)

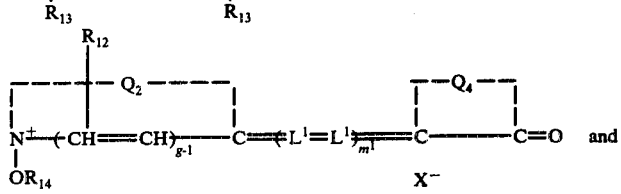

and (F)

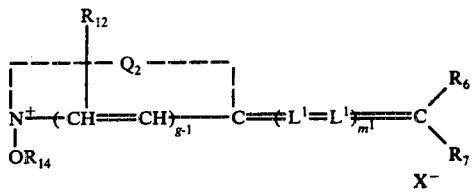

wherein:

$Q_1$, $Q_2$, $Q_4$ and $Q_9$ each represent the nonmetallic atoms necessary to complete a 5 to 6 membered heterocyclic nucleus;

$n$ is a positive integer from 1 to 4;

$m^1$ is a positive integer from 1 to 3;

$R_5$ is an alkyleneoxy radical having one to eight carbon atoms in the alkylene chain;

$g$ is a positive integer from 1 to 2;

$X^-$ is an acid anion;

$L^1$ is a methine linkage;

$R_{14}$ is selected from the group consisting of alkyl and acyl;

$R_{12}$ and $R_{13}$ are each selected from the group consisting of aryl, hydrogen, and alkyl;

$R_{11}$ is selected from the group consisting of alkyl, alkenyl, aryl and alkoxy;

G is selected from the group consisting of an anilinovinyl radical and aryl; and $R_6$ and $R_7$ are each a cyano radical, an ester radical, or an alkylsulfonyl radical, to ultraviolet radiation, 2) overall exposing the photothermographic element to light in the spectral region in which precursor (i) absorbs, and 3) overall heating the photothermographic element to from about 80° C. to about 250° C. for a time of from about 0.5 second to about 60 seconds.

42. The process of claim 41 wherein said non-radiation sensitive reducing agent is a bis-beta naphthol.

43. A process of developing a positive latent image comprising 1) imagewise exposing a non-silver halide photothermographic element comprising a support having thereon a layer comprising a) an oxidation-reduction image-forming combination comprising i) 1,1'-bi-2-naphthol, and ii) silver behenate, b) poly(vinyl butyral), c) phthalimide, and d) a combination of 4-(2,4-dinitrobenzylidene-1-ethyl-1,4-dihydroquinoline and 2-β-anilinovinyl-1-methoxypyridinium p-toluenesulfonate, to ultraviolet radiation, 2) overall exposing the photothermographic element to tungsten light, and 3) overall heating the photothermographic element to from about 80° C to about 250° C for a time of about 0.5 second to about 60 seconds.

44. The process of claim 41 wherein said non-silver halide photothermographic element comprises about 0.1 to about 0.75 mole of said reducing agent precursor per mole of silver and comprises about $10^{-1}$ to about $10^{-5}$ mole of said dye per mole of silver in said photothermographic element.

45. A non-silver halide photothermographic composition as in claim 22 wherein said combination of energy-sensitive organic dyes comprises from about $10^{-1}$ to about $10^{-5}$ mole of said reducing agent precursor (i) and from about $10^1$ to about $10^{-5}$ mole of said photosensitive compound (ii) per mole of silver in said silver salt oxidizing agent.

* * * * *

UNITED STATES PATENT AND TRADEMARK OFFICE

CERTIFICATE OF CORRECTION

PATENT NO. : 4,075,017

DATED : February 21, 1978

INVENTOR(S) : Charles A. Goffe (deceased) and Donald W. Heseltine

It is certified that error appears in the above-identified patent and that said Letters Patent are hereby corrected as shown below:

In the Abstract of the Disclosure, line 3, "spcies" should read ---species---.

Column 3, line 68, "halopehnyl" should read ---halophenyl---.

Column 4, line 41, "6-methylbenzothiaZole" should read --- 6-methylbenzothiazole ---; line 67, "5-methyl2-pyridine" should read --- 5-methyl-2-pyridine ---.

Column 5, line 9, "5-chloro-1,4-diarylbenzimidazoles" should read --- 5-chloro-1,3-diarylbenzimidazoles ---; line 29, "such s" should read ---such as---; line 37, "thiazole" should read ---thiazolo---.

Column 7, line 41, "-CH=CH-CH-" should read --- -CH=CH-CH= ---.

Column 8, lines 15-16, "allylidine" should read ---allylidene---; line 16, "cyanoallylidine" should read ---cyanoallylidene---; line 17, "alkylsulfonylallylidine" should read ---alkylsulfonylallylidene---.

UNITED STATES PATENT AND TRADEMARK OFFICE

CERTIFICATE OF CORRECTION

PATENT NO. : 4,075,017

DATED : February 21, 1978

INVENTOR(S) : Charles A. Goffe (deceased) and Donald W. Heseltine

It is certified that error appears in the above-identified patent and that said Letters Patent are hereby corrected as shown below:

Column 10, line 27, that part of the formula reading "3,3-dialkyl-3-H-pyrrolo" should read --- 3,3-dialkyl-3H-pyrrolo ---.

Column 11, line 11, that part of the formula reading "thiphen-3-" should read --- thiophen-3- ---.

Column 14, line 14, "bis-nephthol" should read ---bis-naphthol---.

Column 15, lines 15-16, "andhyroxygtetronimide" should read ---an hydroxytetronimide---; line 53, "viny" should read ---vinyl---.

Column 27, line 31, "an photosensitive" should read ---a photosensitive---.

Column 30, line 54, "an an acyloxy" should read ---and an acyloxy---; line 55, "abut" should read ---about---.

Column 33, line 8, after "support" insert ---having thereon a layer comprising---.

Column 36, line 58, "$10^{1}$" should read --- $10^{-1}$ ---.

Signed and Sealed this

Sixth Day of June 1978

[SEAL]

Attest:

RUTH C. MASON
*Attesting Officer*

DONALD W. BANNER
*Commissioner of Patents and Trademarks*